United States Patent [19]

Schleich

[11] Patent Number: 4,696,137

[45] Date of Patent: Sep. 29, 1987

[54] BEAM-COLUMN JUNCTION

[75] Inventor: Jean-Baptiste Schleich, Kockelscheuer, Luxembourg

[73] Assignee: Arbed S.A., Luxembourg, Luxembourg

[21] Appl. No.: 823,598

[22] Filed: Jan. 29, 1986

[30] Foreign Application Priority Data

Feb. 1, 1985 [LU] Luxembourg ..... 85753

[51] Int. Cl.[4] ..... E04B 1/00

[52] U.S. Cl. ..... 52/251; 52/334; 52/702; 52/733

[58] Field of Search ..... 52/250–252, 52/280, 283, 333, 334, 702, 703, 722, 723, 729, 732, 733, 735, 740, 260, 721

[56] References Cited

FOREIGN PATENT DOCUMENTS

| | | | |
|---|---|---|---|
| 86570 | 5/1977 | Australia | 52/721 |
| 886291 | 11/1971 | Canada | 52/252 |
| 39263 | 9/1928 | Denmark | 52/250 |
| 2408134 | 9/1974 | Fed. Rep. of Germany | 52/251 |
| 2658020 | 6/1978 | Fed. Rep. of Germany | 52/251 |
| 1475696 | 4/1967 | France | 52/251 |

*Primary Examiner*—Carl D. Friedman
*Assistant Examiner*—Naoko N. Slack
*Attorney, Agent, or Firm*—Karl F. Ross; Herbert Dubno; Ronald Lianides

[57] ABSTRACT

A beam support joint for a column and a beam, which are each constructed from concrete and at least one metal section having a pair of flanges joined by a web and forming at least one recess of the metal section which is filled with concrete and the outer surfaces of the flanges of the metal section are not covered with concrete and are otherwise free. An upper support strap is mounted on an upper flange of the beam, and is attached to the column and the beam. The upper support strap and the webs of both the beam and the column all lie substantially in the same plane. On a flange of the column a lower support plate is advantageously welded which has a width corresponding approximately to the flange of the column. This lower support plate has at least one recess on its upper side which suitably engages at leat one projection provided on a lower flange of the beam. Alternatively the lower support plate can be dispensed with and the upper support strap can be mounted on a cover plate provided on the column with at least one tight fitting screw.

8 Claims, 10 Drawing Figures

BEAM-COLUMN JUNCTION

FIELD OF THE INVENTION

My present invention relates to a joints, braces, and attachment devices for connecting heavy beams or girders made of concrete and metal beams to support and, more particularly, to a beam-support junction for mounting and supporting a girder comprising an iron or steel section whose recesses are filled with concrete on a column wherein outer surfaces of flanges of the girder and column are not covered by concrete and are otherwise free.

BACKGROUND OF THE INVENTION

The use of construction members which are fire resistant and fire-propagation delaying or retardant has gained increasing importance in recent years, especially for high-rise construction. A particularly important structural member of this type is a beam (girder) or column which has a steel structural shape, profile or section (e.g. an I-beam or T-beam) whose compartments are filled with concrete. One type of support, which has no concrete on the outside of a flange, so that at least the outer surface of one flange is exposed, is described in German Patent document DE-OS 28 29 864. The concrete filling the spaces between inner surfaces of the flanges and the web of the metal section, preferably an iron or steel section, is secured to the girder or column by attachment means welded on the inside cross piece or web of the metal section or girder, in order to avoid a loosening of the concrete both at room temperature and at temperatures reached in a fire.

The metal cross section, concrete cross section, and reinforcement cross section contribute load supporting characteristics to the girder or column in accordance with their proportions of the total section and their temperature dependent strengths.

In a fire, with rising temperature there is a continuous load redistribution from the metal or steel section to the concrete section because of the softening of the flange, which constitutes the largest part of the metal section contributing to strength.

Since the reinforcement elements in the concrete have not been positioned optimally heretofore, to counteract the detrimental effects which might occur in a fire, the commonly owned Luxembourg application LU 84 772 teaches the provision of at least one additional steel structural shape, profile or section in the concrete, which is attached to the web of the main section, whose outer flanges are not provided with a concrete cover (see also copending applications Ser. No. 603,509 filed 24 Apr. 1984 and Ser. No. 639,375 of 9 Aug. 1984). When a part of the total section comprising a combination of those sections is mounted in a thermally protected zone, a high bearing strength even under fire conditions, is guaranteed.

Patent document LU 84 966 further describes a kind of combined section, in which at least one iron bar attached to the web of the section is mounted in the concrete.

It is also known to make beam-support joints by means of plates mounted on the above mentioned support, wherein the plates are welded to the flanges of the support or to the web of the support. These measures can be taken on the working sides of these structures. In this structure the beam must be welded to those plates by its web or else mounted by screws on it. Subsequently the recesses or cavities required for the mounting work are filled with concrete. These joints are work sensitive and presuppose a completely concrete covered beam and support, which can be unacceptable for a given class of resistance to fire.

It is also known to mount a beam on a support by brackets. The brackets can be attached to the flange of the support. It is also possible however to weld a plate to the two opposite sides of the flange and to attach a bracket for mounting the beam to this plate. The lower flange of the beam will lie on this structure on the bracket (and eventually be welded there), while both sides of the upper flange of the beam can be welded to the support flange.

In another embodiment, the so called cover plate bracket joint, the beam ends are each provided with a cover plate. The lower flange (and a side of the cover plate) contacts on the bracket, while in the vicinity of the upper beam flange, the cover plate is screwed to the support flange. Here longitudinal or transverse holes in the flange and/or the cover plate are provided. The holes or recesses required for the screwing operations are also subsequently filled with concrete.

OBJECTS OF THE INVENTION

It is an object of our invention to provide an improved beam support joint or girder/column junction whereby disadvantages of prior art systems are obviated.

It is also an object of our invention to provide an improved beam support joint, which requires less work to assemble than those of the prior art and which is in at least some part preassembled.

It is a further object of our invention to provide an improved beam support joint, which permits the definite relative positioning of the beam in the structure by a simple sliding or insertion step.

It is yet another object of our invention to provide an improved beam support joint, which is better able to bear a load when heated, for example by fire, than earlier beam support joints.

SUMMARY OF THE INVENTION

These objects and others which will become more apparent hereinafter are attained in accordance with our invention in a beam support joint (girder/column junction) for a support or column and a beam which are constructed from concrete and at least one metal section each having a web, preferably an iron or steel section or girder, wherein at least one recess of the metal section is filled with concrete and the outer surface of at least one flange of each metal section is not covered with concrete and is otherwise free or exposed.

According to our invention an upper support plate or strap in tension is positioned on the upper flange of the beam, and is attached to the support column and the beam. The upper tension strap and the webs of both of the beam and column all lie substantially in the same plane. A lower support plate being welded to a flange of the column which has a width substantially corresponding to the width of the flange of the column, on which the lower support plate is welded.

In another feature of this preferred embodiment of our invention, the tension plate is beveled to a point at the support. Additionally, the attachment of the upper support strap to the flange of the column is effected by a K-weld seam.

Advantageously the upper support strap can be provided with a cover plate on the column. Here the attachment of the cover plate with the flange of the column is effected by at least one screw.

The tension strap can be attached to the upper flange of the beam by a fillet weld seam. Furthermore on the longitudinal side and the lower side, the support plate is welded by a fillet weld seam to the column. The lower support plate is chamfered in toward the support; also, a sunken weld seam is formed between the lower column plate and the flange of the column.

In another feature of our invention the upper end of the lower support plate is provide with at least one recess, and the lower flange of the beam is provided with at least one projection corresponding to the recess.

In yet another preferred embodiment of our invention the lower support plate can be dispensed with, and as before in the other embodiments, an upper support strap is positioned on the upper flange of the beam, but is attached to the column and the beam by at least one tightly fitting screw. Furthermore the upper column strap and the webs of both the beam and the column all lie substantially in the same plane.

The advantage of our invention is that the weld seam applied to a location in the joint structure between the support strap and the flange of the column lies outside the beam and therefore remains visible until the concrete deck member is mounted or formed on the beam. Further, the changes of the centric moments on the beam are satisfactory and good, and are reduced to about 50% and transferred to the column. It is worth mentioning that smaller dimensions for the beam are made possible by our invention. By the structure attained by our invention lateral (horizontal) forces can be absorbed, and the possibility exists to abandon other stabilizing elements, like trusses or steel concrete cores. In a heated condition, for example, by a fire, the structure has the advantage that with negative frame corner moments the supporting region over the protected beam flange and embracing the tension strap is embedded in the concrete of the deck (roof or floor). Additionally our invention allows for a provisional assembly in the form of skeleton structures; the eventually required weld seams can be provided in a second phase of the assembly work.

BRIEF DESCRIPTION OF THE DRAWINGS

The above and other objects, features, and advantages of our invention will become more readily apparent from the following description, reference being made to the accompanying highly diagrammatic drawings in which.

SPECIFIC DESCRIPTION

Figure 2:
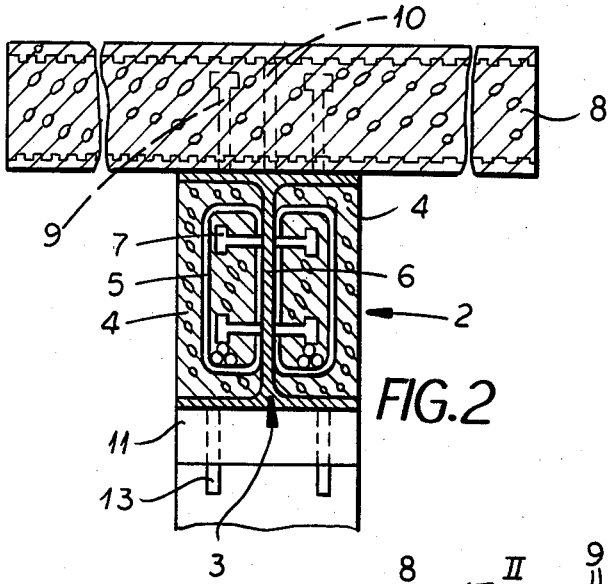
FIG. 2 is a cross sectional view through the beam shown in FIG. 1 taken along the section line II—II in FIG. 1 as seen in the direction of the column.
Figure 1:
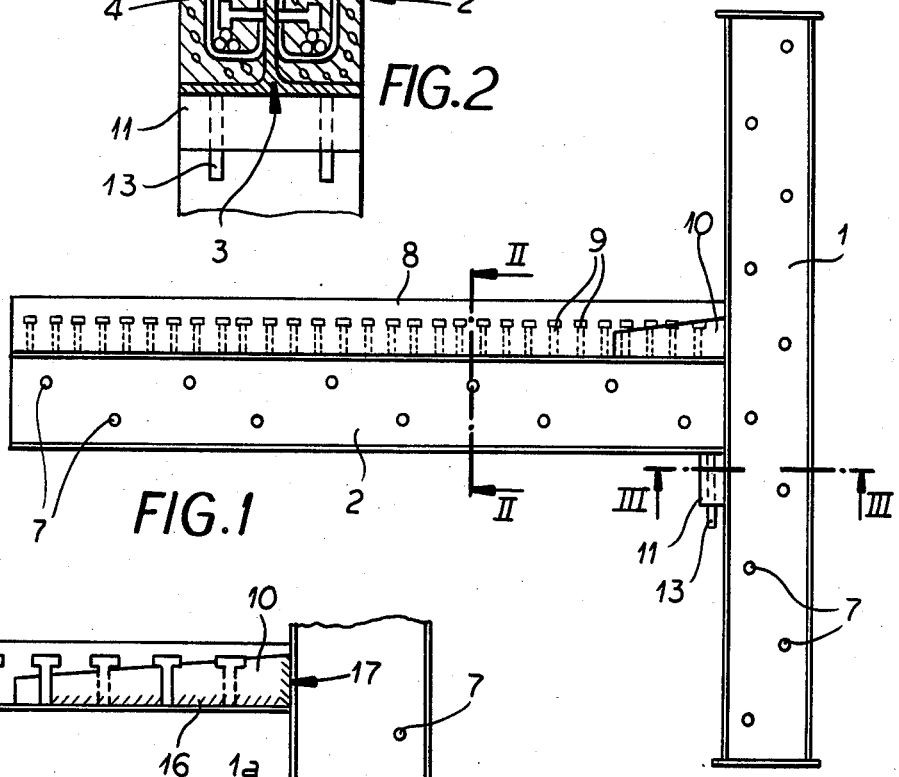
FIG. 1 is a side elevational view of a beam and column, which are provided with a preferred embodiment of a junction according to our invention.
Figure 4:
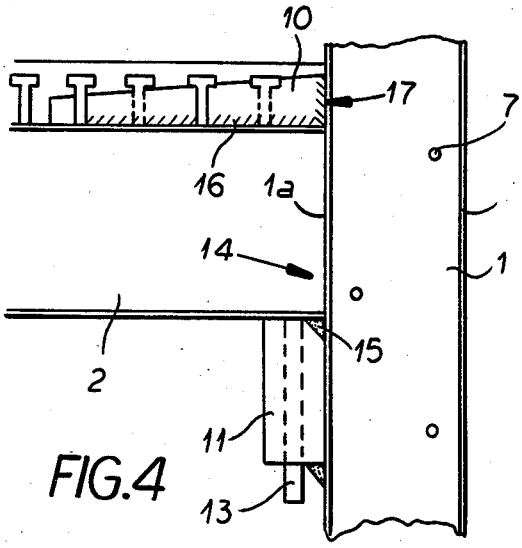
FIG. 4 is an enlarged detail view of the embodiment of the beam support joint shown in FIG. 1.

A column 1 is shown in FIG. 1 on which a beam or girder 2 is mounted. The beam 2 and column 1 should be made as described in German Patent DE-PS 28 29 864 and comprise, as illustrated for the girder, a steel section 3 with concrete filled recesses 4, and a steel reinforcement member 5, wherein the steel reinforcement member 5 is mounted on cross piece or web 6 of the steel section 3 (see FIG. 2).

The column steel section 1*b* has exposed flanges 1*a* and concrete filling the hollows of the steel section.

In order to guarantee the attachment and support of the concrete filled into the recesses 4 a plurality of pins 7 can be welded to the supporting web 6. The attachment of the concrete deck member 8 is guaranteed by pins 9 mounted on the upper flange of the beam 2. Also in FIG. 1 a tension strap 10 and a lower support plate 11 provided for the beam support joint are seen.

Figure 3:
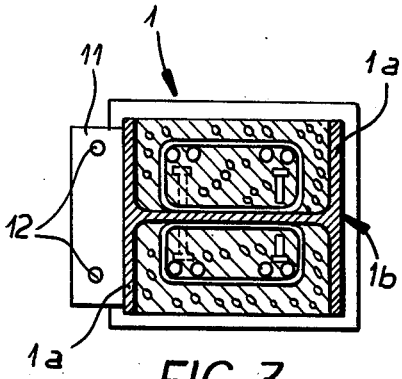
FIG. 3 is a cross sectional view through the column and beam support joint taken along the line III—III of FIG. 1.

As shown in FIG. 3 the lower support plate 11 has approximately the same width as the column flanges and is provided with two holes 12 for receiving the mounting pins 13. These holes 12 and the corresponding mounting pins 13 are not indispensible, but permit assembly of the steel skeleton structure. The welding work can therefore be conducted at a later time. In order to facilitate assembly the dimensions of the pins 13 may be slightly less than the holes 12. Instead of the pins 13 one can also provide any kind of other aid (for example, pyramidal steel projections) which anchor the provisional relative positions of the beam 2 and the column 1. The mounting position of the beam ends 14 should be carefully considered to avoid damage to the supporting flange. Otherwise with negative frame corner moments the direct force of the concrete beam 2 is not provided to the column 1.

The lower support plate 11 is welded by means of a fillet weld to the column support 1 outside on the upper side where the lower support plate is chamfered and a strong sunken weld seam 15 is formed. The recesses weld seam 15 allows a satisfactory support of the beam 2 and thus a balanced distribution of the transverse force of the beam 2 on the lower support plate 11. Since this recessed seam 15 is protected from direct heat radiation, this weld seam in reality increases the time over which transverse force from the beam 2 can be transmitted to the column 1 in a heated condition (i.e. in the case of conflagration). Thus the fire resistance of the unprotected lower support plate 11 can reach 90 minutes.

Figure 4B:
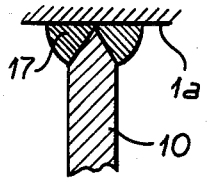
FIGS. 4*b* and 4*c* are sectional views showing the preferred weld seams in greater detail.
Figure 4A:
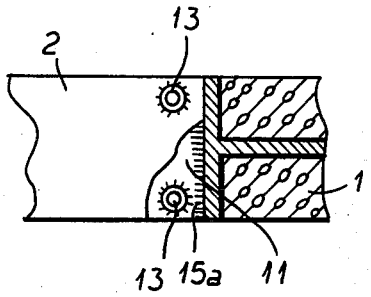
FIG. 4*a* is a view in section through the column showing the underside of the girder, and with the support plate for the latter partly broken away.
Figure 4C:
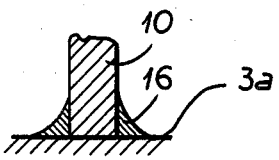
Figure 6:
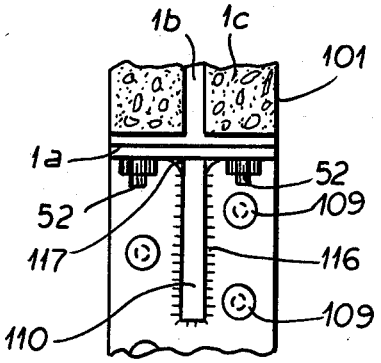
FIG. 6 is a view in section through the column showing the tension strap from above.

The upper support strap 10 is advantageously welded to the upper flange of the beam 2 and is under tension. The weld seam 16 is formed on the beam flange around the strap 10. Then the mounting weld seam 17 is formed on the exposed flange 1*a* of the column 1 at a later time. So that an optimal load or force distribution is attained, this part of the upper support strap 10 is pointed and is connected with the column 1 by a K-weld seam as shown in FIG. 4*b*. The mounting pins 13 and the holes 12 are positioned according to preferred embodiments of our invention, so that the upper support strap 10 likewise lines up in the planes of both the support and beam webs 6.

Figure 5:
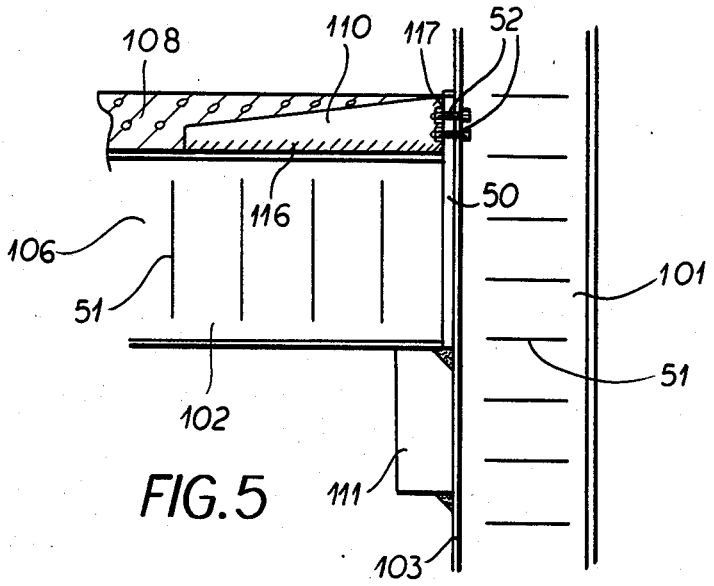
FIG. 5 is a side elevational view of an alternative embodiment for the beam support joint according to our invention.

Another beam support joint is shown in FIG. 5. Here the beam 102 and the tension strap 110 are provided on their adjoining sides with a cover plate 50. The lower flange of the beam 102 and the cover plate underside contacts instead on the support plate 111, while the upper support strap 110 is welded by a K-weld 117 to the cover plate 50 which is screwed by bolts 52 to the column flange 103. The screws 52 are indicated in FIG. 5. Since the screwing operation can be immediately undertaken in all weather conditions, in this preferred embodiment the recesses and projections are dispensed with. It is noted that the bonding of the steel section-concrete filled recesses is guaranteed by the bars 51 welded across the web 106 of the beam 102.

Figure 7:
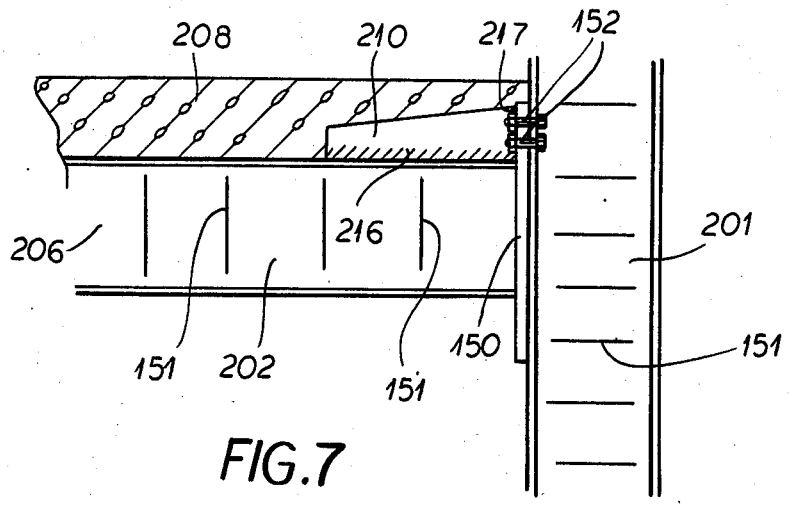
FIG. 7 is a side elevational view of another embodiment of our invention with the lower support plate eliminated.

The embodiment of FIG. 7 eliminates the support plate 111 (of FIG. 5). Here a precise boring of the holes in cover plate 150 is necessary for the screws 152, which are tight fitting screws or reamed bolts. In this case these screws or bolts 152 additionally function as the support plate 111 and will be acted upon by drawing or pulling (occurring on the negative frame bending moments) and transversely on their heads. This dual function is possible in the joint structure according to our invention, since these screws 152 are mounted inside the region of concrete deck member 208 protected from fire.

The upper support strap 210 after completion of the concrete cover 208 lies in the fire protected region and because of this, together with the web of the beam 202 protected by the concrete recess, the web of the column 201 guarantees a standard force or load distribution of the negative frame corner moments in the heated region. The upper strap 210 can therefore exercise its supportive function in a fire, when the lower support plate would be greatly weakened, and the break down time of the structure can be extended to 180 minutes.

We claim:

1. In a beam support joint for a column and a beam, in which said column and said beam are each constructed from concrete and at least one metal section having a pair of flanges joined by a web and defining at least one recess, wherein said recess of said metal section is filled with concrete and outer surfaces of said flanges of said metal section are not covered with concrete and are otherwise exposed, the improvement wherein an upper support strap is positioned on an upper flange of said beam, and is attached to said column and said beam to take up tension, and wherein said upper support strap and said webs of both said beam and said column all lie substantially in the same plane and a lower support plate is welded to one of said outer surfaces of one of said flanges of said column for supporting said beam, which has a width, which substantially corresponds to the width of said flange of said column onto which said lower support plate is welded, said upper strap being provided with a cover plate at said column, and the attachment of said cover plate with said flange of said column is enabled by at least one threaded bolt.

2. In a beam support joint for a column and a beam, in which said column and said beam are each constructed from concrete and at least one metal section having a pair of flanges joined by a web and defining at least one recess, wherein said recess of said metal section is filled with concrete and outer surfaces of said flanges of said metal section are not covered with concrete and are otherwise exposed, the improvement wherein an upper support strap is positioned on an upper flange of said beam, and is attached to said column and said beam to take up tension, and wherein said upper support strap and said webs of both said beam and said column all lie substantially in the same plane and a lower support plate is welded to one of said outer surfaces of one of said flanges of said column for supporting said beam, which has a width, which substantially corresponds to the width of said flange of said column onto which said lower support plate is welded, said lower support plate being chamfered toward said column and a sunken weld seam is formed between said lower support plate and said flange of said column.

3. In a beam support joint for a column and a beam, in which said column and said beam are each constructed from concrete and at least one metal section having a pair of flanges joined by a web and defining at lest one recess, wherein said recess of said metal section is filled with concrete and outer surfaces of said flanges of said metal section are not covered with concrete and are otherwise exposed, the improvement wherein an upper support strap is positioned on an upper flange of said beam, and is attached to said column and said beam to take up tension, and wherein said upper support strap and said webs of both said beam and said column all lie substantially in the same plane and a lower support plate is welded to one of said outer surfaces of one of said flanges of said column for supporting said beam, which has a width, which substantially corresponds to the width of said flange of said column onto which said lower support plate is welded, an upper side of said lower support plate being provided with at least one recess.

4. In a beam support joint for a column and a beam, in which said column and said beam are each constructed from concrete and at least one metal section having a pair of flanges joined by a web and defining at least one recess, wherein said recess of said metal section is filled with concrete and outer surfaces of said flanges of said metal section are not covered with concrete and are otherwise exposed, the improvement wherein an upper support strap is positioned on an upper flange of said beam, and is attached to said column and said beam to take up tension, and wherein said upper support strap and said webs of both said beam and said column all lie substantially in the same plane and a lower support plate is welded to one of said outer surfaces of one of said flanges of said column for supporting said beam, which has a width, which substantially corresponds to the width of said flange of said column onto which said lower support plate is welded, a lower flange of said beam being provided with at least one projection corresponding to said recess in said upper side of said lower support plate.

5. A fire-resistant structure comprising:

a column formed with a steel section having two flanges and a web and defining recesses on opposite sides of said web filled with concrete, said flanges having an exposed surface;

a beam extending perpendicularly to said column and formed with a steel section having horizontal upper and lower flanges and a web lying in a plane common to the web of said column and defining recesses on opposite sides of the web of said beam filled with concrete, said upper and lower flanges having respective exposed surfaces;

a steel tension strap lying in said plane and welded to said exposed surface of said upper flange of said beam while being affixed to said exposed surface of said column; and a support plate welded to said exposed surface of said column below said beam and supporting same.

6. The fire-resistant steel structure defined in claim 5 wherein said strap is embedded in a concrete deck overlying said beam and covering said exposed surface of said beam.

7. The fire-resistant steel structure defined in claim 6 wherein said strap is welded to said exposed surface of said column.

8. The fire-resistant steel structure defined in claim 6 wherein said strap is welded to a plate bolted against said exposed surface of said column.

* * * * *